United States Patent [19]

Sedlmair

[11] Patent Number: 4,526,398

[45] Date of Patent: Jul. 2, 1985

[54] TOURING SKI BINDING

[75] Inventor: Gerhard Sedlmair, Farchant, Fed. Rep. of Germany

[73] Assignee: Marker International, Salt Lake City, Utah

[21] Appl. No.: 465,112

[22] Filed: Feb. 9, 1983

[30] Foreign Application Priority Data

Feb. 10, 1982 [DE] Fed. Rep. of Germany ..... 3204650

[51] Int. Cl.[3] ..... A63C 9/08

[52] U.S. Cl. ..... 280/615

[58] Field of Search ..... 280/614, 615, 618

[56] References Cited

U.S. PATENT DOCUMENTS 4,322,090 3/1982 Loughney ..... 280/615
4,410,200 10/1983 Napflin ..... 280/618

FOREIGN PATENT DOCUMENTS 386120 12/1923 Fed. Rep. of Germany ..... 280/618
2336152 7/1977 France ..... 280/614
2451757 11/1980 France ..... 280/618

*Primary Examiner*—Joseph F. Peters, Jr.
*Assistant Examiner*—Ross Weaver
*Attorney, Agent, or Firm*—D. Peter Hochberg

[57] ABSTRACT

A touring ski binding for mounting on a ski, including: a housing; a platform pivotally attached along a rotational axis to the housing for receiving a ski boot; a restoring biasing means urging the platform to pivot toward the ski; and a connection between the biasing means and the platform lying between the ski and the rotational axis so that the restoring bias moment is kept constant or almost constant as the platform is pivoted away from the ski.

16 Claims, 2 Drawing Figures

FIG. 1
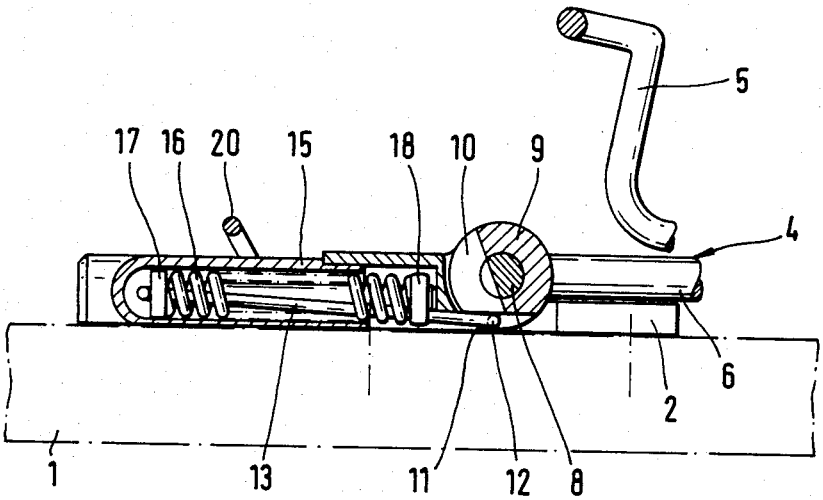
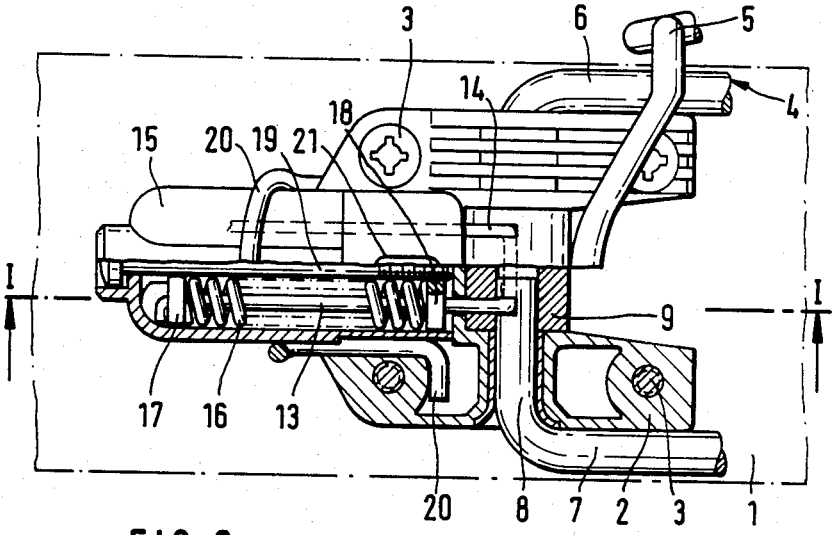
FIG. 2

TOURING SKI BINDING

The present invention relates to touring ski bindings which can be adapted for either cross-country or downhill use. Touring bindings generally include a frame or platform which is attachable to a ski and which grasps the skier's ski boot. When in the cross-country mode, the frame is usually pivoted around a transverse axis lying near the toe of a ski boot being grasped by the binding. The pivotal connection permits a cross-country skier to "walk" on level and uphill areas without fully lifting the ski during each step. When the binding is in its downhill mode, the ski boot and binding are secured to the ski.

Known touring bindings in the cross-country mode include a biasing force which tends to restore the frame, when pivoted away from the ski, toward the ski to assist a skier in walking uphill. Examples of such constructions appear in German Pat. Nos. 2,553,885 and 2,656,635. In the former, a helical spring surrounding the transverse axis reacts against the relative pivoting of the ski and the frame to urge them together. In the latter, a cam mounted on the transverse axis cooperates with a spring-biased catch which may be moved in position along the length of the ski. In these constructions the restoring force of the spring increases approximately proportionally with the amount of the pivoting of the frame away from the ski. The proportional increase in restoring force is undesirable since it increases the work a skier must do to walk up steep terrain.

SUMMARY OF THE INVENTION

In the present invention a touring binding is provided in which skier comfort is increased, particularly in the cross-country mode for climbing steep terrain. Comfort is improved by providing a force tending to restore the pivoted platform toward the ski so that the force is kept constant or almost constant or if necessary decreases as the separation between the ski and platform increases. The improvement is achieved by providing a biasing means that is joined to a connecting member. The biasing means produces a moment on the platform urging it toward the ski. The connecting member is attached to the platform along the transverse axle. The biasing means is connected to the connecting member at a location offset from a plane generally parallel to the ski and containing the pivotal axis of the axle so as to produce the desired restoring moment. The connecting member rotates with the axle so that as the platform pivots away from the ski, the point of connection between the biasing means and the connecting member approaches the previously mentioned plane. Since the distance between the connection point and the axis is the moment arm for the restoring moment, that moment is almost constant through at least a portion of the arc as the platform is pivoted away from the ski.

In a preferred embodiment of the invention, the biasing means includes two helical springs mounted in a housing which forms part of the mounting member at the toe end of the binding. Each spring has one end bearing on an adjusting plate that engages a screw rotatably mounted in the housing. By turning the screw, the plate is moved so that the tension on the springs can be changed. Thereby, the initial platform restoring force may be adjusted. By providing a window in the housing through which the position of the plate may be observed and a scale along side the window, an indicator of the relative initial restoring force can be incorporated in the binding. Each of the legs of a U-shaped coupling passes through one of the springs and is attached to the end of that spring opposite the end bearing on the adjusting plate. The bridge of the U-shaped coupling passes between the ski and the connecting member and engages a hook on the connecting member. The legs of the U-shaped element pass through slots in the connecting member to permit its rotation with the axle.

BRIEF DESCRIPTION OF THE DRAWINGS

FIG. 1 is a cross-sectional side view of an embodiment of the invention taken along plane I—I of FIG. 2; and FIG. 2 is a top view, partially in section, of the embodiment of the invention depicted in FIG. 1.

DETAILED DESCRIPTION OF THE PREFERRED EMBODIMENT

The same preferred embodiment of the invention is shown in FIGS. 1 and 2 and like elements are given the same reference numerals. The upper half of FIG. 2 shows an external view of the embodiment while the lower half of FIG. 2 shows the same embodiment in section.

A portion of a ski 1 is shown in FIGS. 1 and 2. Directions generally along the length of the ski are referred to as longitudinal and those generally across it are referred to as transverse. The embodiment of the inventive touring binding includes a housing 2 through which the binding is attached to ski 1 by screws 3. A portion of a platform or frame 4 of the binding for receiving the sole of a ski boot is shown as a bent rod. A portion of a pivoting wire strap 5 is shown. Strap 5 engages and releases the toe portion of a ski boot. The longitudinal side rails 6 and 7 of platform 4 are joined by a transverse portion or rail 8 which is pivotally mounted in housing 2. This pivotal mounting allows the platform to pivot away from the ski when the rearward or heel portion of the platform is not secured to the ski and the binding is in its cross-country mode (the means for securing the rearward portion of the platform to the ski, and for converting the binding between the cross-country and downhill modes are not part of the present invention and are not shown in the drawings). A connecting means in the form of a generally circular, cylindrical sleeve 9 is fixed to transverse rail 8, preferably centrally. Sleeve 9 includes two longitudinal slots 10 on the side toward the front ski tip. Preferably slots 10 are symmetrically disposed about a medial vertical plane passing through ski 1, e.g., the plane dividing the upper and lower halves of FIG. 2. A hook in the form of a projection 11 is disposed on sleeve 9 recessed from the outermost dimensions of sleeve 9. Hook 11 lies between the rotational axis of transverse rail portion 8 and the top surface of ski 1 and is oriented to engage an object applying tension toward the front ski tip (to the left in the figures). A bridging portion 12 of a U-shaped coupler having legs 13 and 14 engages hook 11. Each of legs 13 and 14 pass through one of the slots 10. The slots are dimensioned to allow free passage of legs 13 and 14 as platform 4 is pivoted away from ski 1 and sleeve 9 rotates.

A spring housing 15, part of housing 2, having a pair of longitudinal barrels encloses a pair of longitudinally disposed springs 16, only one of which is visible in FIG. 2. The springs are preferably identical in operating characteristics and are disposed symmetrically with respect to a vertical medial plane passing through ski 1 and the longitudinal axis of ski 1. The distal end of each spring with respect to sleeve 9, bears upon a spring plate 17 which is slidably mounted within spring housing 15. The end of a leg of the coupler passing through the spring, leg 13 within spring 16 in the lower half of FIG. 2, is attached to spring plate 17. When leg 13 moves, it takes along spring plate 17 so as to compress or release spring 16.

An indicator plate 18 is slidably mounted in housing 2 and the ends of spring 16 proximate sleeve 9 bear on it. Legs 13 and 14 pass through indicator plate 18. A longitudinally disposed screw 19 having a head accessible through the forwardmost end of housing 2, is rotatably mounted in housing 2 and engages indicator plate 18.

Turning screw 19 adjusts the position of indicator plate 18 and the amount of compression of springs 16. The position of indicator plate 18 is visible through an aperture 21 in housing 2. A scale may be placed alongside aperture 21 so that the relative degree of compression of springs 16, the prestress on the springs, can be visually determined from the position of indicator plate 18. A wire strap 20 extending from and spanning housing 2 can be used as an anchor for a ski boot strap.

The operation of the binding in its cross-country mode is simple. A ski boot is placed on platform 4 and grasped by pivoting wire strap 5. Any strap or talon on the boot may be secured to wire strap 20. As the skier "walks" up an incline, platform 4 pivots around transverse portion 8 in response to the lifting of the boot by the skier. Sleeve 9 pivots with transverse portion 8, counterclockwise in FIG. 1. As the pivoting occurs, hook 11 pulls the bridging portion of coupler 12. Legs 13 and 14 are drawn to the right, in the figures, causing compression of springs 16. The increased compression creates a restoring moment which tends to bring platform 4 back toward ski 1. The moment is equal to the spring force multiplied by the moment arm. The moment arm is the distance between hook 11 and the transverse axis of rotation of transverse portion 8. As platform 4 rotates, sleeve 9 rotates raising the position of hook 11 above ski 1 toward the axis of rotation. That is, as platform 4 pivots away from ski 1, the moment arm is reduced since hook 11 approaches an imaginary plane lying generally parallel to ski 1 and containing the transverse axis of rotation. As a result, the restoring moment does not constantly increase as platform 4 pivots farther away from ski 1 and skier comfort is improved, especially in traversing steep areas.

The initial restoring force may be varied to accommodate the physical characteristics and preferences of a skier by adjusting screw 19. The initial force, which is present to resist the initial lifting of platform 4 from ski 1, may be determined by observing the position of plate 18 within aperture 21.

Although the invention has been described with regard to a touring binding, it should be appreciated that it finds applicability in a cross-country ski binding.

The invention has been described with reference to a preferred embodiment. Various modifications and additions without departing from the spirit of the invention will be recognized by those of skill in the art. Accordingly, the scope of the invention is limited solely by the following claims.

I claim:

1. A ski binding comprising:

housing means for mounting the binding to a ski;

platform means for receiving a ski boot, including a transverse axle having an axis of rotation, said axle being pivotally attached to said housing means for pivoting said platform means with respect to said ski about the axis of rotation of said axle;

biasing means disposed in said housing means, and connected to said housing means and said platform means for establishing a restoring bias moment urging said platform to pivot toward said ski as said platform means is pivoted away from said ski; and connection means fixed to said axle for connecting said biasing means to said platform means at a location offset from a plane, but approaching the plane as said platform is pivoted away from said ski, said plane being generally parallel to said ski and containing the acis of rotation of said axle, for reducing the force required to rotate said platform means as said platform means is displaced from the ski and keeping the restoring bias moment substantially constant during such displacement.

2. The invention of claim 1 wherein said biasing means comprises at least one spring disposed within said housing means.

3. The invention of claim 2 further including biasing adjusting means connected to said biasing means for adjusting the tension of said spring.

4. The invention of claim 3 wherein said biasing adjustment means comprises an adjusting plate slidably mounted on said housing means and a screw rotatably mounted on said housing means and engaging said adjusting plate, one end of said spring bearing on said adjusting plate for adjustment of the tension of said spring in response to rotation of said screw.

5. The invention of claim 4 wherein said housing means includes an opening for viewing the relative position of said adjusting plate.

6. The invention of claim 1, said platform having a longitudinal axis of symmetry and said biasing means comprising two springs disposed generally symmetrically with respect to the axis of symmetry within said housing means.

7. The invention of claim 6 further including coupling means for coupling said springs to said connecting means.

8. The invention of claim 7 wherein said coupling means comprises a U-shaped coupler having generally parallel legs, one of said legs extending through each of said springs, said coupler also having a bridging portion joining said legs for connection to said connecting means.

9. The invention of claim 8 wherein one of said legs extends through each of said springs and is connected to an end of the spring through which it extends.

10. The invention of claim 9 further including at least one spring plate slidably mounted on said housing means, one end of each spring bearing on said spring plate and said legs being attached to said plate.

11. The invention of claim 8 wherein said bridging portion and the adjacent portions of said legs are disposed between said ski and said connecting means.

12. The invention of claim 8 further including biasing adjustment means connected to said biasing means for stressing the tension of said springs.

13. The invention of claim 12 wherein said biasing adjustment means comprises an adjusting plate slidably mounted on said housing means and a screw rotatably mounted in said housing means and engaging said adjusting plate, one end of each of said springs bearing on said adjusting plate for adjustment of the tension of said springs in response to rotation of said screw.

14. The invention of claim 13 wherein said housing means includes an opening for viewing the relative position of said adjusting plate.

15. The invention of claim 1 wherein said connecting means includes hook means offset from the axis of rotation of said axle and disposed between said ski and the axis of rotation.

16. The invention of claim 15 wherein said connecting means comprises a sleeve, said sleeve having at least one longitudinal slot means for passage of said biasing means when said platform means is pivoted.

* * * * *